US005315738A

United States Patent [19]

Pinto et al.

[11] Patent Number: 5,315,738

[45] Date of Patent: May 31, 1994

[54] MULTIPLE BALE OPENER HAVING INCLINED, ADJUSTABLE TRACKS

[75] Inventors: Akiva Pinto, Duesseldorf-Wittlaer; Guenter Lucassen, Haltern; Reinhard Schmidt, Gescher, all of Fed. Rep. of Germany

[73] Assignee: Hergeth Hollingsworth GmbH, Duelmen, Fed. Rep. of Germany

[21] Appl. No.: 847,052

[22] Filed: May 22, 1992

[30] Foreign Application Priority Data

Oct. 5, 1989 [DE] Fed. Rep. of Germany ... 8915583[U]
Aug. 16, 1990 [DE] Fed. Rep. of Germany ..... 4025908

[51] Int. Cl.[5] ..... D01G 13/00

[52] U.S. Cl. ..... 19/145.5; 19/80 R

[58] Field of Search ..... 19/80 R, 97.5, 145.5, 19/81; 198/586, 587, 588, 598, 861.1, 861.2, 861.3, 861.4, 861.5, 861.6

[56] References Cited

U.S. PATENT DOCUMENTS

| | | | |
|---|---|---|---|
| 2,938,239 | 5/1960 | Leineweber, Jr. et al. | 19/80 |
| 3,381,341 | 5/1968 | Platt et al. | 19/80 |
| 3,576,284 | 4/1971 | Fellous et al. | 226/97 |
| 3,577,599 | 5/1971 | Goldammer | 19/145.5 |
| 3,736,624 | 6/1973 | Alt et al. | 19/80 R |
| 4,100,651 | 7/1978 | Wornall et al. | 19/145.5 |
| 4,377,021 | 3/1983 | Peters | 19/80 R |
| 4,467,502 | 8/1984 | Lytton et al. | 19/80 |
| 4,557,021 | 12/1985 | Nash et al. | 19/80 |
| 4,587,691 | 5/1986 | Höset et al. | 19/8 R |
| 4,747,187 | 5/1988 | Leifeld | 19/80 R |
| 4,813,616 | 3/1989 | Hösel et al. | 19/145.5 |
| 4,888,857 | 12/1989 | Pinto et al. | 19/80 R |
| 4,920,613 | 5/1990 | Binder et al. | 19/80 |
| 4,951,358 | 8/1990 | Binder et al. | 19/80 |
| 5,025,533 | 6/1991 | Faas et al. | 19/145.5 |
| 5,189,308 | 2/1993 | Kortlang et al. | 19/80 R |

FOREIGN PATENT DOCUMENTS

| | | |
|---|---|---|
| 2416944 | 1/1975 | Fed. Rep. of Germany . |
| 3210602 | 10/1982 | Fed. Rep. of Germany . |

OTHER PUBLICATIONS

PCT International Application No. PCT/EP90/01657 dated Apr. 18, 1991, with attached International Search Report dated Mar. 13, 1991.

PCT International Preliminary Examination Report (English translation) dated Oct. 7, 1991.

*Primary Examiner*—Clifford D. Crowder
*Assistant Examiner*—Larry D. Worrell, Jr.
*Attorney, Agent, or Firm*—Leatherwood, Walker, Todd & Mann

[57] ABSTRACT

In a multiple bale opener (1) for a plurality of rows of fiber bales (8) arranged side by side and supplied on transport means (6), comprising a reduction device (2) moved in a surface of action (16) having a plane of action extending at an angle to the plane of supply of the transport means (6). It is contemplated that the reduction device (2) consists of at least one action and provided at the end of the transport means (6).

20 Claims, 7 Drawing Sheets

MULTIPLE BALE OPENER HAVING INCLINED, ADJUSTABLE TRACKS

BACKGROUND OF THE INVENTION

The invention relates to a multiple bale opener for a plurality of fiber bale rows arranged side by side and supplied on transport devices, comprising a reduction means moved in a surface of action, the plane of action of the reduction device extending at an angle to the feeding plane of the transport device, as well as to a method for opening a plurality of adjacently supplied rows of fiber bases by reducing the surfaces of the fiber bales in a surface of action at an oblique angle.

Reduction devices of the type mentioned are known in various embodiments. From DE-OS- 29 31 500, a bale opener is known wherein a row of bales is fed horizontally towards an oblique plane of action of a reciprocable reduction means.

A multiple bale opener is known from DE-OS- 37 30 487, wherein a plurality of adjacently arranged rows of bales are supplied on a horizontal transport means towards an oblique plane of action of a reduction device. The reduction device consists of a reciprocable tower having an arm extending transversal to the direction of movement and having a milling device. The arm is height-adjustable and the milling device is inclined corresponding to the plane of action of the reduction device extending oblique to the horizontal feeding plane. When the tower is reciprocated, a synchronous up and down movement of the arm must be provided in order to keep the oblique angle of the plane of action. The tower may be pivoted by 180° in order to be able to alternately reduce another row of bales on a second transport device.

A bale opener is known from German Laid Open No. DE-OS 32 10 602 in which the fiber bales are set in circles on a ground surface. The reduction device, the plane of action of which extends substantially parallel to the ground surface, reduces the circularly arranged fiber bales down to the ground level in a helical manner. It is a drawback of such a bale opener that no new bales can be fed continuously and that the mixture of the fiber flocks is restricted to the number of fiber bales present in the circular surface of action.

SUMMARY OF THE INVENTION

It is an object of the invention to provide a multiple bale opener with a high reduction capacity that consumes less space and requires less mechanical constructional effort.

According to the invention, the object is solved by a reduction device consisting of at least one reduction device provided at the end of the transport means and rotating in the plane of action without being advanced. Further, the method of the invention contemplates to supply the rows of fiber bales for reduction towards the plane of action with a stationary circularly reduced surface of action.

The reduction device, rotating about a stationary axis, can reduce a large surface of action, while consuming minimum space. Since the reduction device is always rotating in the same plane of action without being advanced, it has only one degree of freedom of movement, namely the rotation so that the mechanical effort is reduced considerably when compared to known bale openers. The large surface of action in combination with the simple sequence of motion of the reduction device allows a high reduction capacity at a continuous feed of bales. Due to the simplified mechanical structure, the susceptance to trouble is reduced, whereby the productivity is further increased. It is an advantage of the oblique reduction of the fiber bales that, due to the transverse cut through the fiber bales, one can already produce a mixture of the fibers in a bale. Thus an additional, subsequent mixing device can be omitted. Contrary to reciprocating reduction devices, a continuous mixing is obtained due to the rotation of the reduction device. Since the plane of action of the reduction device is stationary, the energy consumption is less than in reduction devices moved up and down.

Preferably, there is a separate transport means provided for each row of fiber bales. Feeding the different rows of fiber bales separately, allows to set optional mixing ratios, it being possible to reduce different batches one after the other without interruption and without adjusting the supply of bales.

In one embodiment of the present invention it is contemplated that the plane of action of the reduction device extends oblique to the horizontal plane. In this embodiment, the rows of fiber bales are preferably fed towards the surface of action of the reduction device on a horizontal plane of supply so that the transport means can be of relatively simple construction.

In a further embodiment it is provided that, in the area of the surface of action, the planes of supply of the transport means extend oblique to the horizontal plane. Preferably, the plane of action of the reduction device is horizontal. Thus, the rows of fiber bales are fed to the surface of action of the reduction device in a ramp-like manner. It is an advantage of this embodiment that a reduction device rotating in a horizontal plane is statically and dynamically more stable.

Preferably, it is provided that the transport means for the individual rows of fiber bales are adjustable with respect to their ramp angles. By virtue of the ramp angle, it is possible to adjust to different heights of fiber bales. Further, the supply towards the surface of action may be changed by means of the slope of the ramp.

In one embodiment it is contemplated that the reduction device consists of at least one milling head accommodated in an arm, which rotates about an axis spaced equidistantly from the lateral outer edges of the fiber bale rows. Such a reduction device may use milling heads already used in practice.

In a further embodiment it is provided that the reduction device rotates in an annular guiding without a central axis. It is the advantage of this embodiment that no free space is required between the fiber bale rows for the rotational axis of the reduction device. Further, such a construction is more stable when the plane of action of the reduction device is oblique relative to the horizontal plane.

Only one milling roll acts upon the fiber bales in the direction of rotation of the reduction device. This reduces the mechanical effort of the reduction of the fiber bales, thereby reducing the costs for a milling head.

Preferably, the reduction device rotates only in one direction of rotation. In this way, the reduction device and the milling roll can be optimized for one direction of rotation and the structural design may be simplified.

In a preferred embodiment it is contemplated that the transport speeds of the transport means can be set separately for each fiber bale row. It is an essential advantage of individually adjustable transport or supply speeds that the mixing ratio of different fiber bale rows can be adjusted continuously. In the extreme case, individual rows of fiber bales may be halted if a certain fiber quality is not needed. Given an appropriate number of fiber bale rows, any desired mixing ratio may be set. It is possible, in particular, to change from one batch to another at any time without delay and without having to compile a new set of bales. This results in the further advantage that also small batches may be provided.

A plurality of reduction devices rotating in the same plane of action may be provided in succession. In this way, the reduction capacity may be increased and the reduction capacity of the individual milling rolls may be reduced, whereby the size of the flocks is reduced and the mixture is improved. Further, an additional mixing is obtained due to the utilization of two reduction devices.

It is also possible to provide a plurality of reduction devices side by side, rotating in the same plane of action and being arranged transversal to the direction of supply of the fiber bale rows so that the number of simultaneously reduced fiber bales is increased.

In doing so, it is also possible that the ranges of action of the reduction devices intersect. In this manner, the fiber bale rows reduced by the two reduction devices may be reduced more intensively, in particular when adjacently arranged reduction devices are used, it being possible to simultaneously increase the transport speed of the associated transport means.

The transport means may feed the fiber bale rows from opposite sides of the reduction device. Thus, the number of fiber bale qualities available for reduction may be increased further.

BRIEF DESCRIPTION OF THE DRAWINGS

The following is a detailed description of embodiments of the present invention with reference to the accompanying drawings.

In the Figures.

DESCRIPTION OF THE PREFERRED EMBODIMENT

Figure 1:
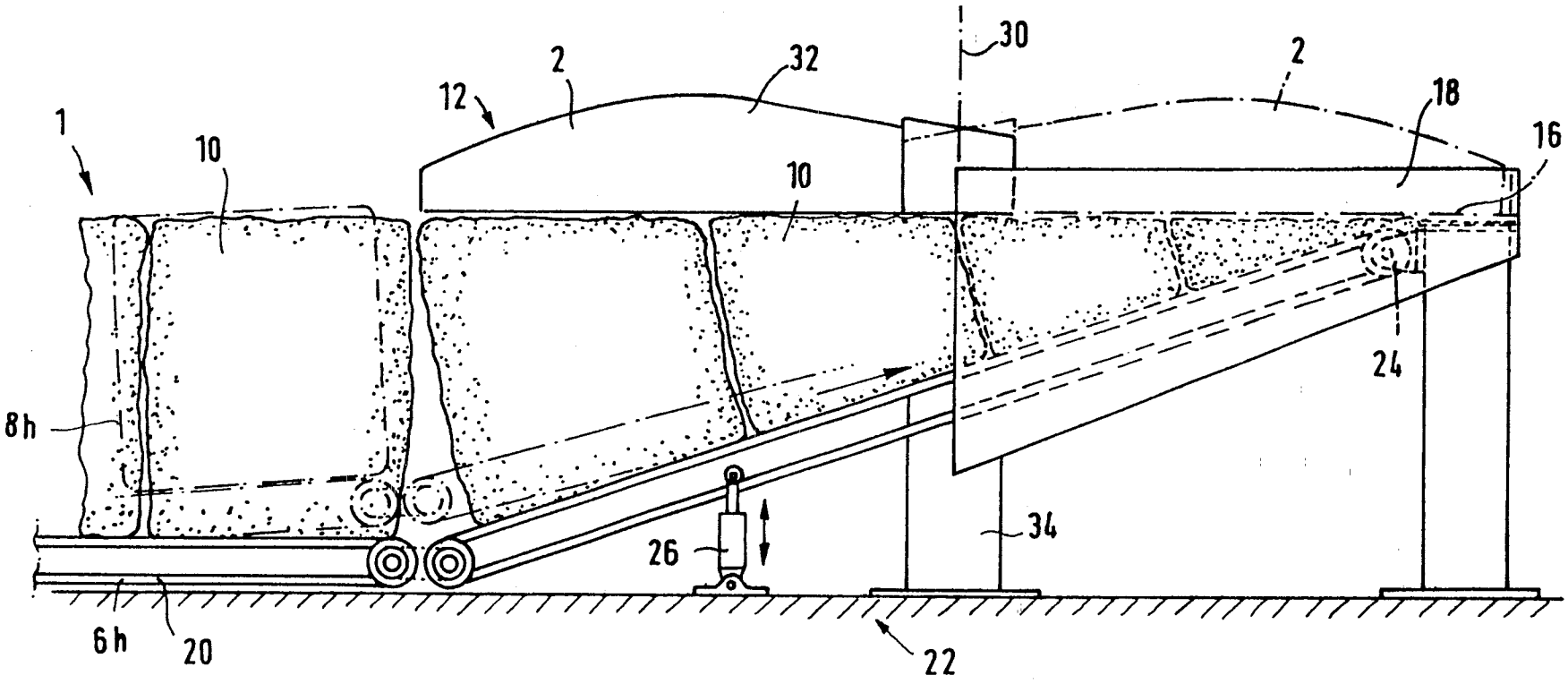
FIG. 1 is a first embodiment with a horizontal plane of action of the reduction device and an oblique supply plane of the transport means.
Figure 2:
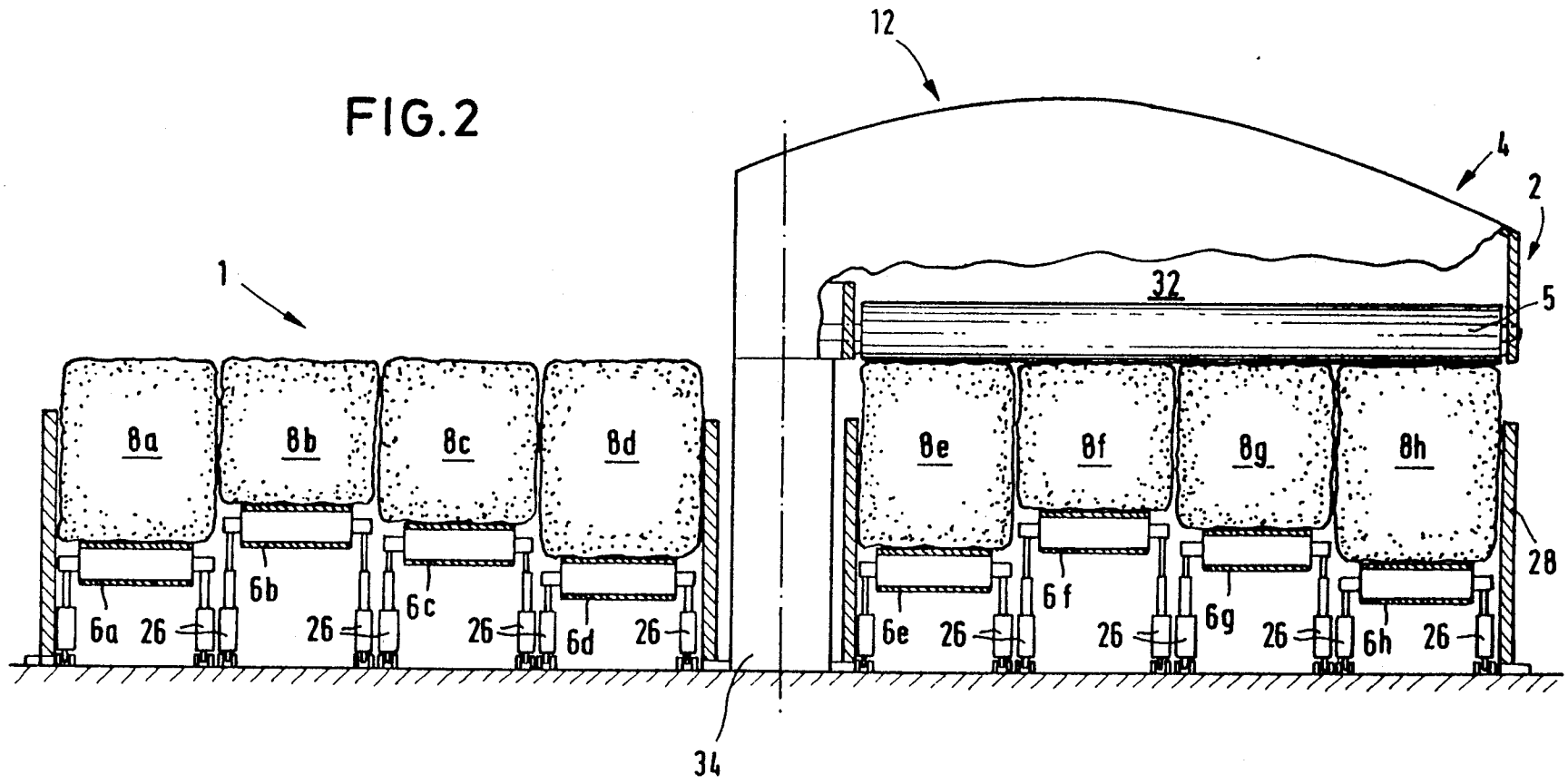
FIG. 2 is a section along line II—II of FIG. 1.
Figure 3:
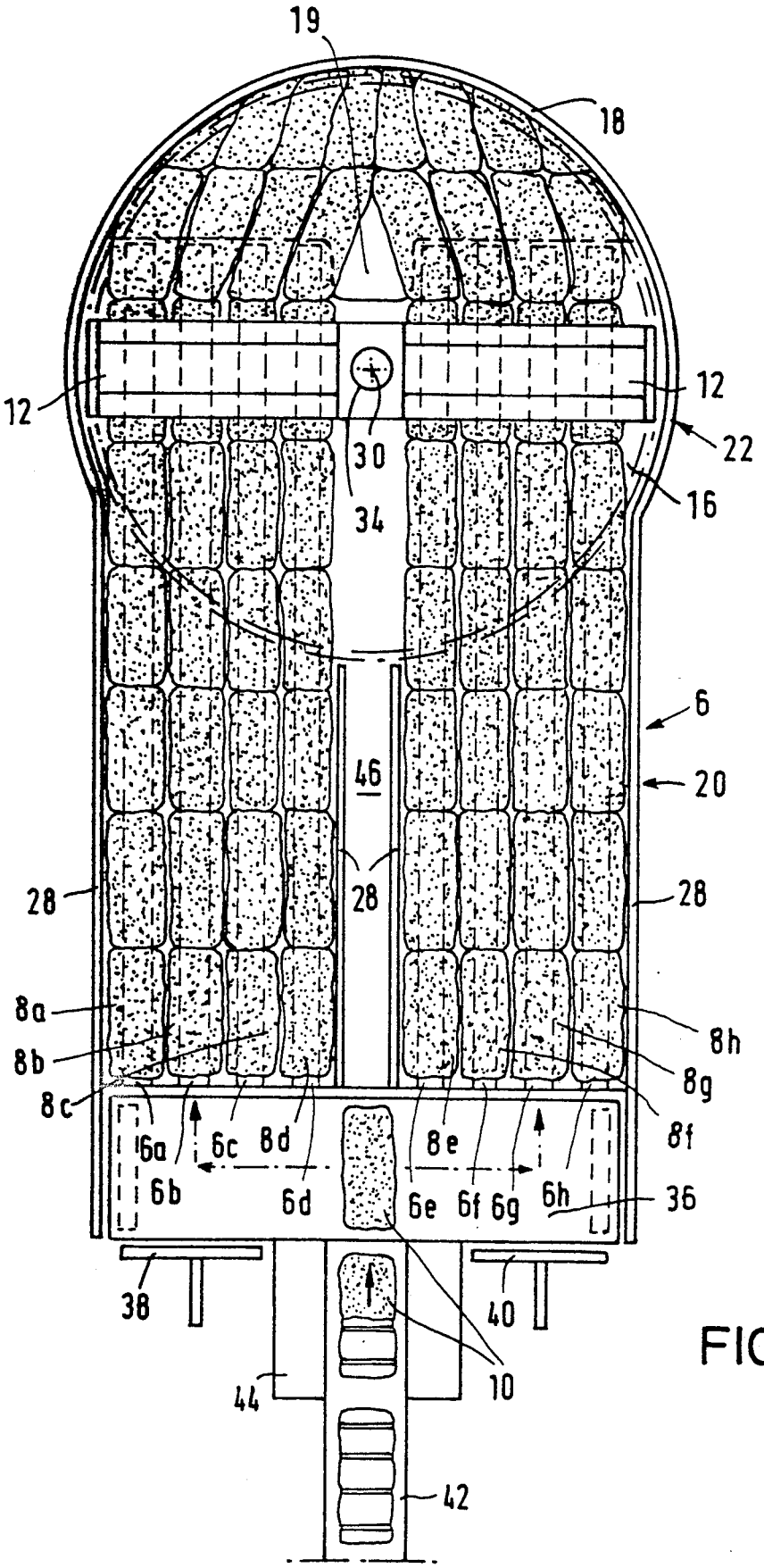
FIG. 3 is a top plan view of the embodiment of FIGS. 1 and 2.

The multiple bale opener 1 has a transport means 6 consisting of a plurality of mutually parallel adjacent transport paths 6*a* to 6*h* which, according to the first embodiment of FIGS. 1 to 3, can accommodate a total of eight adjacent fiber bale rows 8*a* to 8*h*.

Preferably, the individual transport paths 6*a* to 6*h* consist of continuously driven transport belts that extend substantially horizontally in a front section 20, seen in the transport direction, on which the batch may be put. In a rear section 22 situated in the area of a horizontal surface of action 16 worked upon by the reduction device 2, the transport paths rise in a ramp-like manner such that the end portion of the transport belts reaches up to the plane of action of the surface of action 16. At this upper end of the transport means, the transport paths 6*a* to 6*h* are supported in bearings 24 for pivotal movement about a common pivot axis, the lower end of the oblique transport paths 6*a* to 6*h* being capable to be lifted in dependence of the height of the fiber bales 10 supplied such that the upper edge of the respective supplied rows of fiber bales will enter the plane of action of the reduction device 2 at the same height.

The transport belts 6*a* to 6*h* are preferably segmented once or several times, the last segment possibly being located at the beginning of the surface of action 16. The segmented transport belts 6*a* to 6*h* may be connected in succession in the direction of supply by means of a toothed belt or the like. The front section 20 of the transport path has its front end—seen in the direction of transport—pivotably supported so that the respective fiber bale rows 8*a* to 8*h* may be lifted differently in section 20 of the transport path, thereby allowing a continuous transition to the last section 22 of the transport path.

The lifting of the transport belts in the area of the surface of action 16 is performed with the devices 26, e.g. linear motors, like hydraulic piston-cylinder units, which, as may be seen in FIG. 2, may be arranged in pairs at the sides of the transport paths 6*a* to 6*h* and which may be adjusted to a desired height by means of a suited control device. Similar lifting devices may also be provided for the front section 20 of the transport path. As depicted in FIG. 2, the adjacent fiber bale rows 8*a* to 8*h* may be guided by lateral support walls 28 up to the end of the ramp formed by the transport paths 6*a* to 6*h*.

In the embodiments of FIGS. 1 to 3, the surface of action 16 of the reduction device 2 approximately covers the length of four successively arranged fiber bales 10, as well as a total of eight adjacent fiber bales.

The reduction device 2 consists of a milling head 4 accommodated in an arm 12, which rotates about a vertical axis 30. Preferably, the milling head holds but one milling roll 5. Within the milling head 4, the torn-off fiber flocks are hurled upward into a suction chamber 32 from where they are pneumatically transported away via a suction duct.

The milling head 4 rotates continuously in the same direction of rotation at a constant speed and in a horizontal plane of action. The fact that at the beginning of the surface of action 16 of the reduction device 2, the height of the transport paths 6*a* to 6*h* is adjusted to the respective bale heights, it is possible to set fiber bales 10 of different dimensions on the individual transport paths. Therefore, a different fiber bale quality may be assigned to a respective fiber bale row, which may be mixed with the other fiber bale qualities at an optional mixing ratio in dependence of the speed of transport.

The mixing ratio may readily be set or varied at any time by regulating the transport speed of the transport belts.

It is no problem to readjust the batch to another mixture without having to change the bale supply. If, for instance, the new mixture is to exclude a certain fiber quality, it is possible to simply halt the respective transport belt.

Thus, the multiple bale opener 1 allows to compile different batches having different mixing ratios from a uniform supply of bales, and to work thereupon.

As evident from FIG. 2, a gap is formed between respective sets of four fiber bale rows 8*a* to 8*d*, 8*e* to the reduction device 2 extends. The arm 12 rotates on a support 34 which may have a suction channel for the suction chamber 32 and, moreover, a rotatory converter for current transmission provided at the transition to the arm 12.

FIG. 3 is a top plan view of the multiple bale opener 1 of FIGS. 1 and 2. At the front end of the fiber bale rows 8*a* to 8*h*, a transport belt 36, running transversely, is provided onto which respective new fiber bales 10 may be pushed via a further transport belt 42. Prefixed to the transversely running transport belt 36 there may be provided a device 44 for the disposal of the packing and the like. After that, the respective new fiber bale 10 is displaced behind the one or the other row of fiber bales 8*a* to 8*h* to the desired position, whereupon the respective new fiber bale 10 may be moved to onto the following transport means 6 by means of a pushing device 38 or 40. Thus, a constant supply of fresh fiber bales 10 to the fiber bale rows 8*a* to 8*h* is ensured, allowing a continuous operation.

At the end of the transport means 6, the rotating reduction device 2 with the milling head 4 accommodated in the arm 12 is arranged. The plane of supply of the transport belts 6*a* to 6*h* in the front section 22 intersects with the plane of action of the reduction device 2 in the frontmost area of the fiber bale rows 8. The transport belts 6*a* to 6*h* may end even before and may be prolongated by means of metal guide sheets arranged in the plane of supply. In order to limit the forward feed of the bales, the end of the transport means 6 may be provided with a vertical guide sheet 18 that defines the surface of action 16 in the feeding direction. The guiding sheet 18 is arcuate in shape, the curvature being concentric to the rotational axis 30 of the reduction device 2. The guide sheet 18 may encompass a curvature of 180°, thus semi-circularly delimiting the ends of the fiber bale rows. It is another effect of the guide sheet 18 that the fiber bale rests lying behind the rotational axis 30—seen in the feeding direction—are deflected towards the center, where they fill the empty gap 46 no longer needed at that time.

The reduction device 2 may also have two or more arms 12 projecting at the same angular distance from each other.

Figure 4:
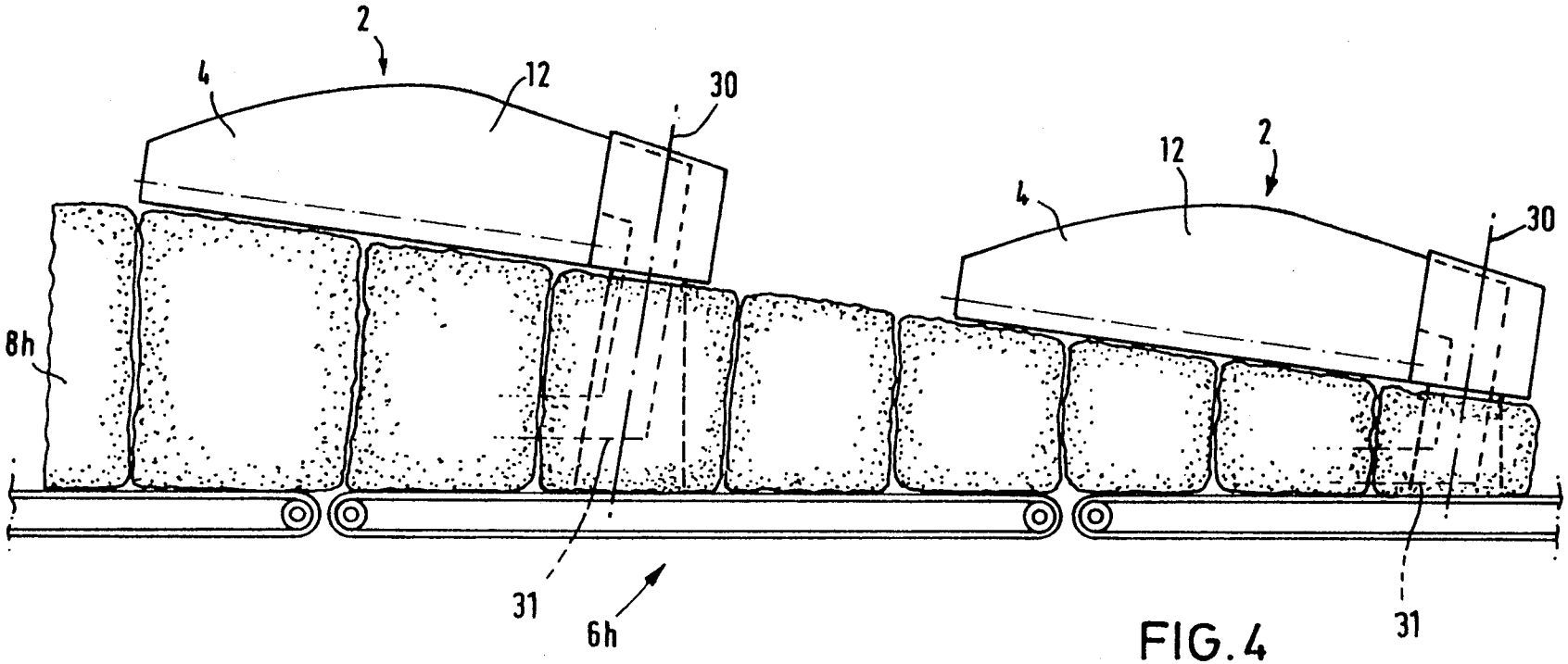
FIG. 4 is an embodiment with a horizontal supply plane for the bale rows and a plane of action of the reduction device extending oblique to the horizontal plane.

FIG. 4 shows an embodiment with two successively arranged reduction devices 2, the surfaces of action 16 of which intersect. Therefore, the movement of the milling heads 4 must be synchronized. The fact that, thereby, the surface of action 16 is considerably increased in the direction of supply, the angle of inclination between the surface of action of the reduction device 2 and the plane of supply of the transport means 6 may be reduced, the number of the fiber bales that are simultaneously reduced being considerably increased and the mixture being improved.

In contrast to the embodiments of FIGS. 1 to 3, the reduction devices 2 of FIG. 4 rotate about a rotational axis 30 inclined with respect to the vertical plane. Other than in the embodiments of FIGS. 1 to 3, the transport means 6 preferably have no ramp and are horizontal. Suction ducts 31 are provided in the supports 34, which transport the fiber flocks thrown into the suction chamber of the milling heads 4 away. Here, the gap 46 between the fiber bale rows 8*a* to 8*d* and 8*e* to 8*h* may be used for accommodating the suction ducts 31.

Figure 5:
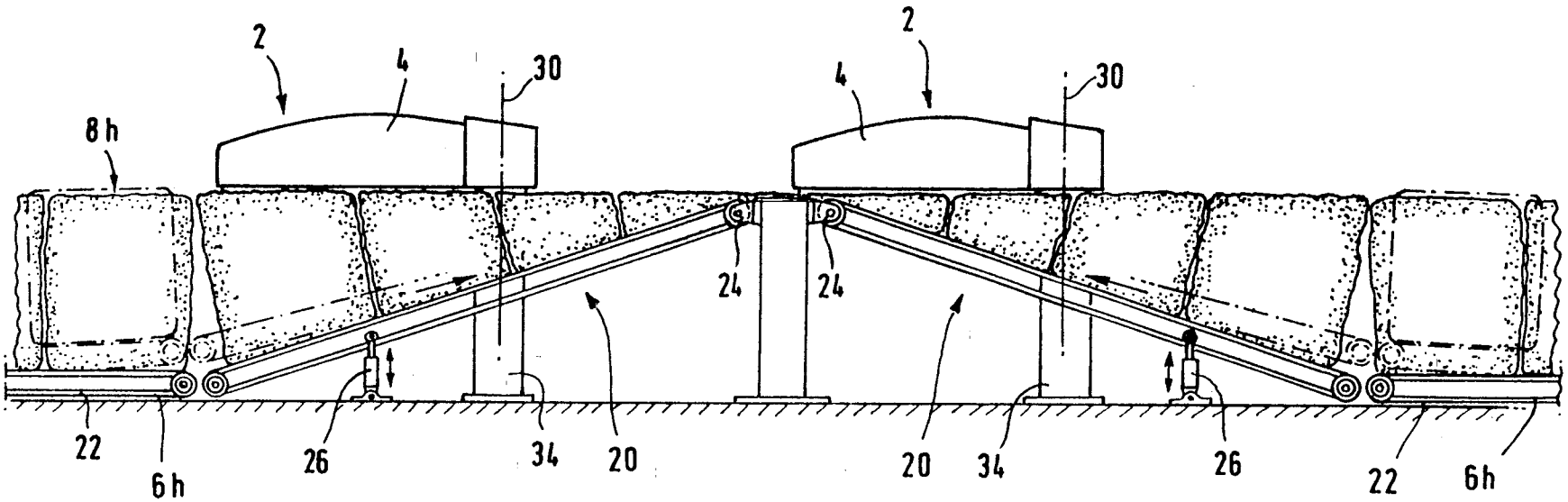
FIG. 5 is a third embodiment of a multiple bale opener, similar to the one shown in the first embodiment, wherein the bale rows are fed from two opposite directions.

The embodiment of FIG. 5 shows a double ramp arrangement, wherein the rows of fiber bales 8 are supplied to two reduction devices 2 from different directions, the reduction devices being arranged at the end of the respective row of fiber bales 8. The surface of action 16 of the two reduction devices may possibly intersect or only touch. Should there be a danger of the arms 12 of the two reduction devices 2 colliding, the movement of the milling heads 4 must be synchronized.

Figure 6:
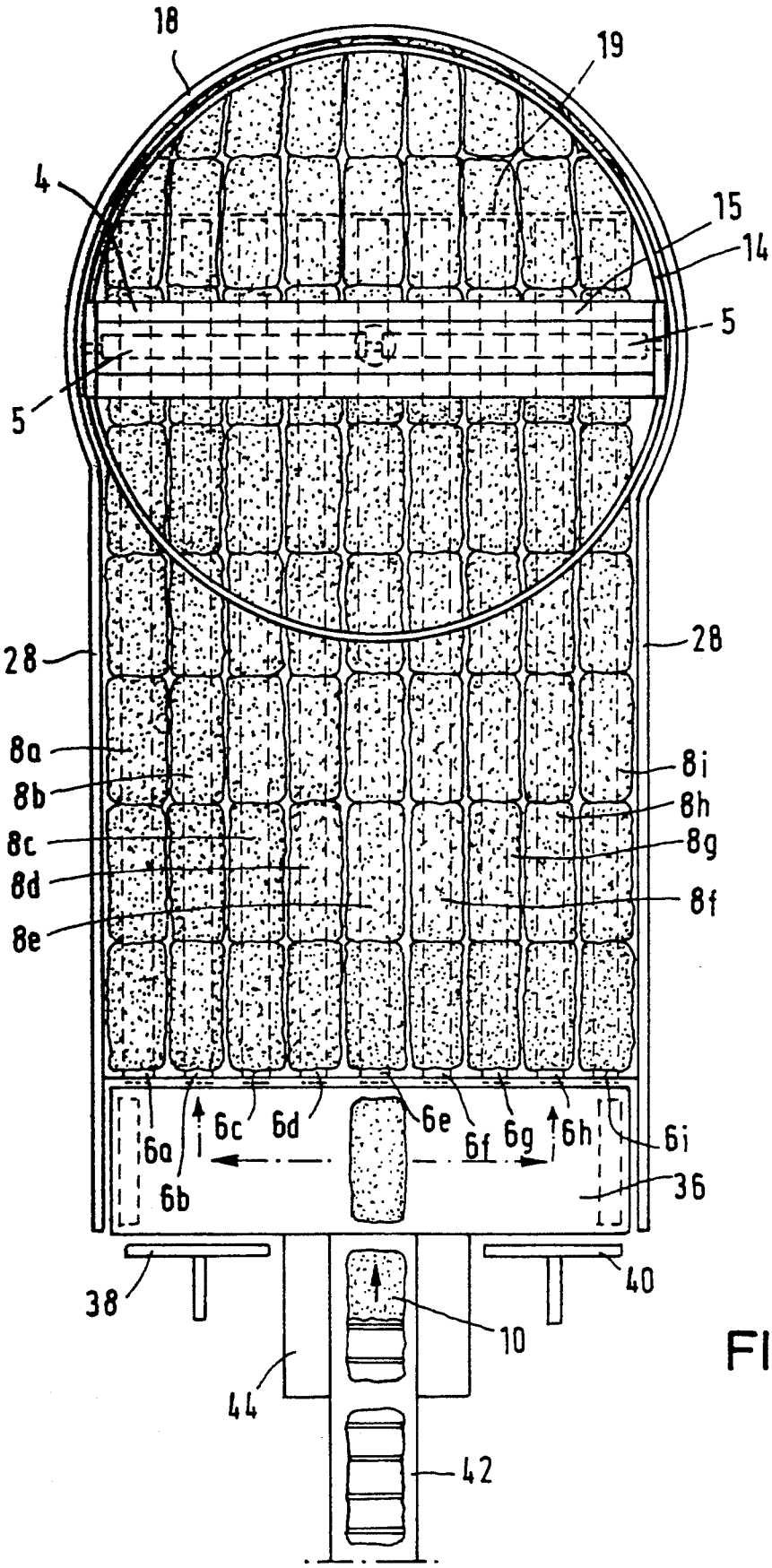
FIG. 6 is a fourth embodiment with a reduction device rotating in an annular guiding.

FIG. 6 shows a top plan view of an embodiment wherein a two-winged double milling head 15 consisting of two oppositely arranged milling heads 4 is provided, which does not, rotate on a support 34 but in an annular guiding 14, e.g. a track circle. In this way, the gap 46 may be dropped, whereby the capacity of the multiple bale opener 1 is further increased. The milling head 4 comprises two milling rolls 5 rotating in opposite directions. The suction air flow must be discharged in the upward direction, while the drive may be provided for instance at the two front ends of the milling head in connection with the annular guiding 14. This embodiment may be realized with a horizontal annular guide 14 and a ramp-like feeding of the fiber bales 10, or with an oblique annular guiding 14 and horizontally fed fiber bales.

In the embodiments of FIGS. 3 and 6, the end of the transport devices 6*a* to 6*i* is followed by a support sheet 19 extending in the plane of supply. In the area of the support sheet 19, the fiber bales 10 are pushed forward by the fiber bales following on the transport means 6*a* to 6*i*.

The lateral support walls 28 may be connected with the guide sheet 18 for supporting the fiber bales 10.

Figure 7:
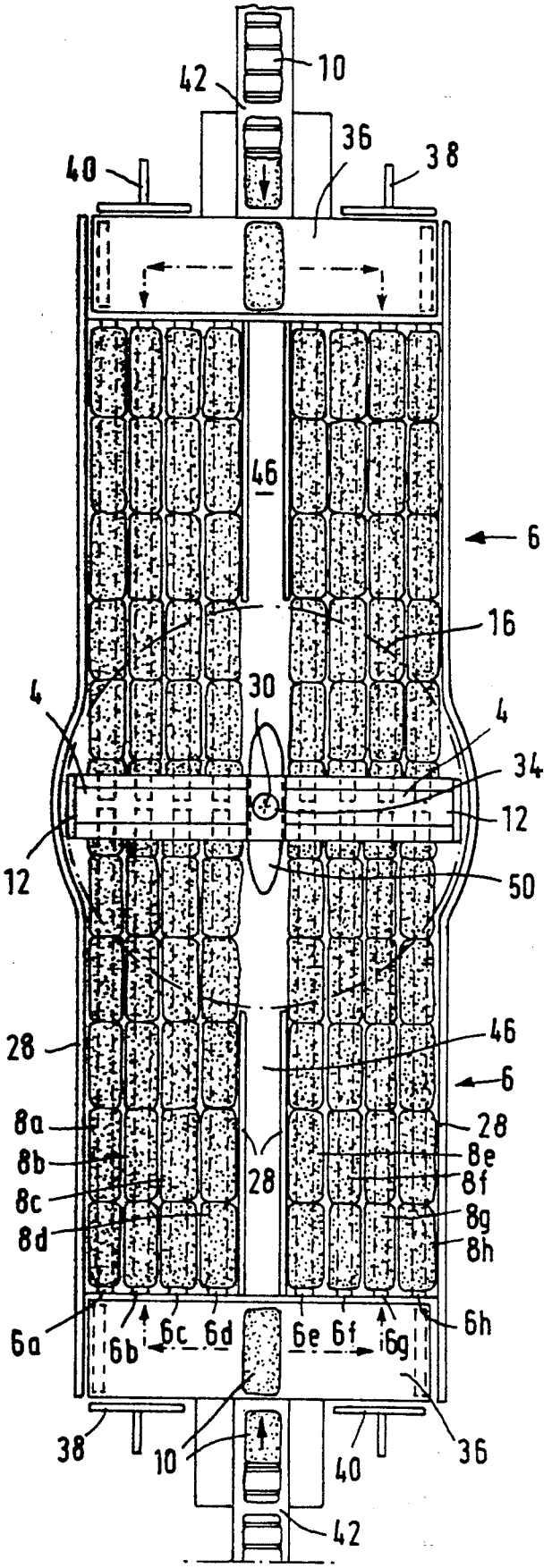
FIG. 7 is a top plan view of the fifth embodiment, similar to the third embodiment, with a single reduction device for two transport means.

The embodiment of FIG. 7 is similar to that of FIG. 5, differing only in that there is only one reduction device for both transport means 6. The embodiment shows a two-winged arm, the wings of which project in opposite directions. Each wing of the arm comprises a milling roll 5 of its own. The planes of supply of the transport devices 6 intersect the surface of action of the reduction device 2 in an area extending transversal to the feeding direction near the axis of rotation 30.

Instead of the two-winged arm 12 rotating on the support 34, one may also implement an annular guiding as used in the embodiment of FIG. 6. The support 34 may be lined with a guiding body 50 that keeps the adjacent rows of fiber bales 8 in position in the area of the surface of action 16 of the milling head. The guiding body 50 may be elongated to fill the gap 46 up to the outermost edge of the surface of action 16.

The milling heads 4 described may comprise two oppositely rotating milling rolls 5, preferably, however, they hold only one milling roll which preferably has a tangential component of the rotational movement corresponding to the rotational movement of the arm.

In the embodiments of FIGS. 1 to 7, a subsequent mixing is obsolete due to the excellent mixing effect of the invention.

The features of the invention, disclosed in the above specification, the drawings, as well as in the claims, and even if described only in connection with a particular embodiment, are considered essential for the realisation of the invention in its various embodiments, be it individually or in any optional combination.

We claim:

1. A multiple bale opener for receiving a plurality of adjacently arranged rows of fiber bales, comprising:

transport means for continuously supplying the plurality of adjacently arranged rows of fiber bales, said transport means defining a supply end and a plane of supply for supplying the bales; said transport means including a plurality of transport tracks, each said transport track being configured for transporting a rows of fiber bales;

reduction means for reducing the fiber bales supplied by said transport means, said reduction means including at least one milling head for milling and thereby reducing the fiber bales, said milling head being movable about a substantially horizontal plane of action wherein milling occurs, said plane of supply extending at an incline handle with respect to said plane of action;

transport adjustment means connected to each of said transport tracks for individually adjusting the incline angle of said transport tracks with respect to one another to allow for substantially uniform reduction of fiber bales of differing heights; and said at least one milling head being provided adjacent to said supply end of said transport means and rotatable about an axis extending substantially perpendicular to said plane of action.

2. The multiple bale opener of claim 1, wherein said reduction means includes said at least one milling head being accommodated in said arm, said arm being rotatable about an axis substantially centered between the plurality of adjacently arranged rows of fiber bales.

3. The multiple bale opener of claim 1, further comprising an annular guiding device and wherein said reduction means includes at least one rotatable arm which is rotatable in said annular guiding device.

4. The multiple bale opener of claim 1, further comprising a single milling roll acting upon the fiber bales in the direction of rotation of said reduction means.

5. The multiple bale opener of claim 1, wherein said reduction means rotates in one direction only.

6. The multiple bale opener of claim 1, further comprising a plurality of reduction means, wherein said plurality of reduction means rotate in the same plane of action and are arranged in succession in the feeding direction of the rows of fiber bales.

7. The multiple bale opener of claim 1, wherein a plurality of reduction means rotating in the same plane of action are arranged side by side transverse to the feeding direction of the rows of fiber bales.

8. The multiple bale opener of claim 1, wherein the plane of action of said reduction means nd said plane of supply of the fiber bales intersect.

9. The multiple bale opener of claim 1, wherein the plane of supply and the plane of action intersect at the end of said surface of action of the reduction means.

10. The multiple bale opener of claim 9, wherein at the supply end of said transport means arcuate guide sheets are arranged, said arcuate guide sheets being substantially co-axial with the rotational axis of said reduction mans.

11. The multiple bale opener of claim 1, wherein said transport means feed the rows of fiber bales to said reduction means from opposite sides.

12. The multiple bale opener of claim 11, wherein the respective planes of supply approach one another in the plane of action of said reduction means and in the plane of the rotational axis of said reduction means.

13. The multiple bale opener of claim 4, wherein the direction of rotation of said milling roll and the direction of rotation of said miling head substantially coincide.

14. The multiple bale opener of claim 1, wherein said milling head rotates about the axis of rotation, and wherein the axis of rotation is substantially stationary.

15. A method for opening a plurality of rows of fiber bales fed side by said, comprising:

providing a substantially stationary circular reducing plane of action;

transporting the rows of fiber bales individually on separate individual transport tracks;

obliquely reducing the surfaces of the rows of the fiber bales by supplying the rows of fiber bales of the substantially stationary circular reducing plane of action;

mixing the fibers taken from the fiber bales during said reducing; and selectively varying the speed of the individual transport tracks with respect to one another for varying the mixing of the fibers in a predetermined mixing ratio.

16. The method of claim 15, wherein when said reduction means has a substantially horizontal plane of action, the rows of fiber bales are supplied at an angle to the plane of action of said reduction means.

17. The method of claim 15, wherein the rows of fiber bales are supplies to the surface of action from opposite directions.

18. The method of claim 15, wherein when said plane of supply is substantially horizontal, the rows of fiber bales are supplies to a surface of action of said reduction means extending substantially transverse to the horizontal.

19. The method of claim 16, further comprising selectively varying the angle of supply of the fiber bales by said transport tracks with respect to said plane of action to allow for substantially uniform reduction of fiber bales of differing heights.

20. The method of claim 15, further comprising providing a plurality of substantially circular reduction planes of action arranged in succession with respect to transport of the fiber bales and successively reducing the fiber bales in said plurality of substantially circular reduction planes of action.

* * * * *

UNITED STATES PATENT AND TRADEMARK OFFICE

CERTIFICATE OF CORRECTION

PATENT NO. : 5,315,738
DATED : MAY 31, 1994
INVENTOR(S) : PINTO, ET AL.

It is certified that error appears in the above-indentified patent and that said Letters Patent is hereby corrected as shown below:

Column 1, line 13, delete "bases" and substitute --bales--.

Column 7, line 17, delete "handle" and substitute --angle--.

Column 7, line 52, delete "nd" and substitute --and--.

Column 8, line 3, delete "mans" and substitute --means--.

Column 8, line 39, delete "supplies" and substitute --supplied--.

Column 8, line 43, delete "supplies" and substitute --supplied--.

Signed and Sealed this

First Day of November, 1994

*Attest:*

*Attesting Officer*

Bruce Lehman

BRUCE LEHMAN

*Commissioner of Patents and Trademarks*